US006918216B2

(12) United States Patent
Hoy et al.

(10) Patent No.: US 6,918,216 B2
(45) Date of Patent: Jul. 19, 2005

(54) TUBULAR SKYLIGHT ASSEMBLY

(75) Inventors: Walter S. Hoy, Huber Heights, OH (US); Mark W. Hopkins, Conover, OH (US)

(73) Assignee: Fox Lite, Inc., Fairborn, OH (US)

( * ) Notice: Subject to any disclaimer, the term of this patent is extended or adjusted under 35 U.S.C. 154(b) by 162 days.

(21) Appl. No.: 10/644,117

(22) Filed: Aug. 20, 2003

(65) Prior Publication Data

US 2005/0039410 A1 Feb. 24, 2005

(51) Int. Cl.[7] ..... E04B 7/18

(52) U.S. Cl. ..... 52/200; 52/22; 52/220.8; 359/150; 359/591

(58) Field of Search ..... 52/22, 72, 199–200, 52/203, 220.8; 362/147, 150, 365, 597; 182/177

(56) References Cited

U.S. PATENT DOCUMENTS

| | | | | | |
|---|---|---|---|---|---|
| 3,012,375 | A | * | 12/1961 | Wasserman | 52/22 |
| 4,339,900 | A | * | 7/1982 | Freeman | 52/200 |
| 4,733,505 | A | * | 3/1988 | Van Dame | 52/22 |
| 5,502,935 | A | * | 4/1996 | Demmer | 52/200 |
| 5,546,712 | A | * | 8/1996 | Bixby | 52/200 |
| 5,655,339 | A | * | 8/1997 | DeBlock et al. | 52/200 |
| 5,896,713 | A | * | 4/1999 | Chao et al. | 52/200 |
| RE36,496 | E | | 1/2000 | Sutton | |
| 6,219,977 | B1 | | 4/2001 | Chao et al. | |
| 6,256,947 | B1 | | 7/2001 | Grubb | |
| 6,604,329 | B2 | * | 8/2003 | Hoy et al. | 52/200 |
| 6,813,864 | B2 | * | 11/2004 | Landis | 52/200 |

* cited by examiner

*Primary Examiner*—Winnie Yip
(74) *Attorney, Agent, or Firm*—Jacox, Meckstroth & Jenkins

(57) ABSTRACT

A square skylight panel is vacuum-formed of light transmitting sheet plastic and has a lower peripheral flange which projects under roof shingles. The skylight panel covers a one-piece upper coupler member which is vacuum-formed of light transmitting sheet plastic and has an upper flange projecting under the skylight panel flange. A flexible and collapsible cylindrical tube has an upper end portion surrounding a lower wall portion of the upper coupler member and a lower end portion surrounding an upper wall portion of a similarly formed lower coupler member having a bottom flange received within a square frame attached to a ceiling and supporting a light diffusing ceiling panel. The skylight panel, upper and lower coupler members and ceiling panel define three dead air chambers providing for high thermal insulation, and the upper coupler member provides natural light into the attic between the roof and ceiling.

24 Claims, 2 Drawing Sheets

12
18
44
46
37
46
35
38
14
28
32
16
20
110
42
51
18
69
22
26
28
67
14
69
16
60
10
62
75
64
78
80
94
82
98
98
105
91
96
92
84
88
90
102

37
48
44
44
51
38
42
46
46
42
44
54
54
28
64
60
69
20
26
23
24
69
62
78
80
84
98
88
98
99
99
91
98
99
102
102
90
99

TUBULAR SKYLIGHT ASSEMBLY

BACKGROUND OF THE INVENTION

This invention relates to tubular skylight assemblies, for example, of the general type disclosed in U.S. Pat. Nos. 6,219,977, 6,256,947, and Reissue No. 36,496. Such tubular skylights are commonly installed within the attic of a home and extend from an inclined roof to a flat horizontal ceiling and usually include a cylindrical light conducting tube which may be flexible and collapsible or formed of rotatably connected cylindrical tube sections. The upper open end portion of the tube is covered by a light transmitting skylight usually formed of a plastics material and having an outwardly projecting flange which projects under the roof covering or shingles. The lower open end of the tubing is commonly covered by a light transmitting plastic panel or lens which is attached to the ceiling by a frame. The flexible and collapsible light conducting tube is sometimes constructed of an extruded plastic film surrounding a helically wound wire for accommodating the horizontally offset or angular condition between the inclined roof rafters and the horizontal ceiling joists.

SUMMARY OF THE INVENTION

The present invention is directed to an improved tubular skylight assembly which provides for conducting light from above an inclined roof through an attic and into a room having a horizontal ceiling. The tubular skylight assembly of the invention provides for simple and convenient installation of the assembly within a short time period and also provides for a series of dead air chambers within the assembly for increase thermal insulation. In addition, the assembly provides for transmitting natural light into the attic around the skylight assembly. In accordance with a preferred embodiment of the invention, a one-piece skylight panel is vacuum-formed from light transmitting sheet plastics material and has a peripheral flange adapted to project under the shingles along the top and opposite sides of the skylight panel and project above the shingles along the bottom of the skylight panel.

The plastic skylight panel is attached to an upper square flange of an upper coupler member which is also vacuum-formed from light transmitting sheet plastics material and has a generally round bottom wall portion. A flexible and axially collapsible light transmitting tube includes a light reflecting tubular film surrounding a helically wound reinforcing wire, and the tube has an upper end portion attached to the bottom wall portion of the upper coupler member. A lower end portion of the tube is attached to a generally round top wall portion of another vacuum-formed coupler member having an outwardly projecting square bottom flange. The flange is received within a square rectangular frame attached to the ceiling and supporting a square light diffusing panel or lens. The skylight, coupler members and lens define three dead air chambers to provide substantial thermal insulation and prevent internal condensation. The upper coupler member also provides for transmitting light into the attic space between the inclined roof and the horizontal ceiling.

Other features and advantages of the invention will be apparent from the following description, the accompanying drawings and the appended claims.

DESCRIPTION OF THE PREFERRED EMBODIMENT

Figure 1:
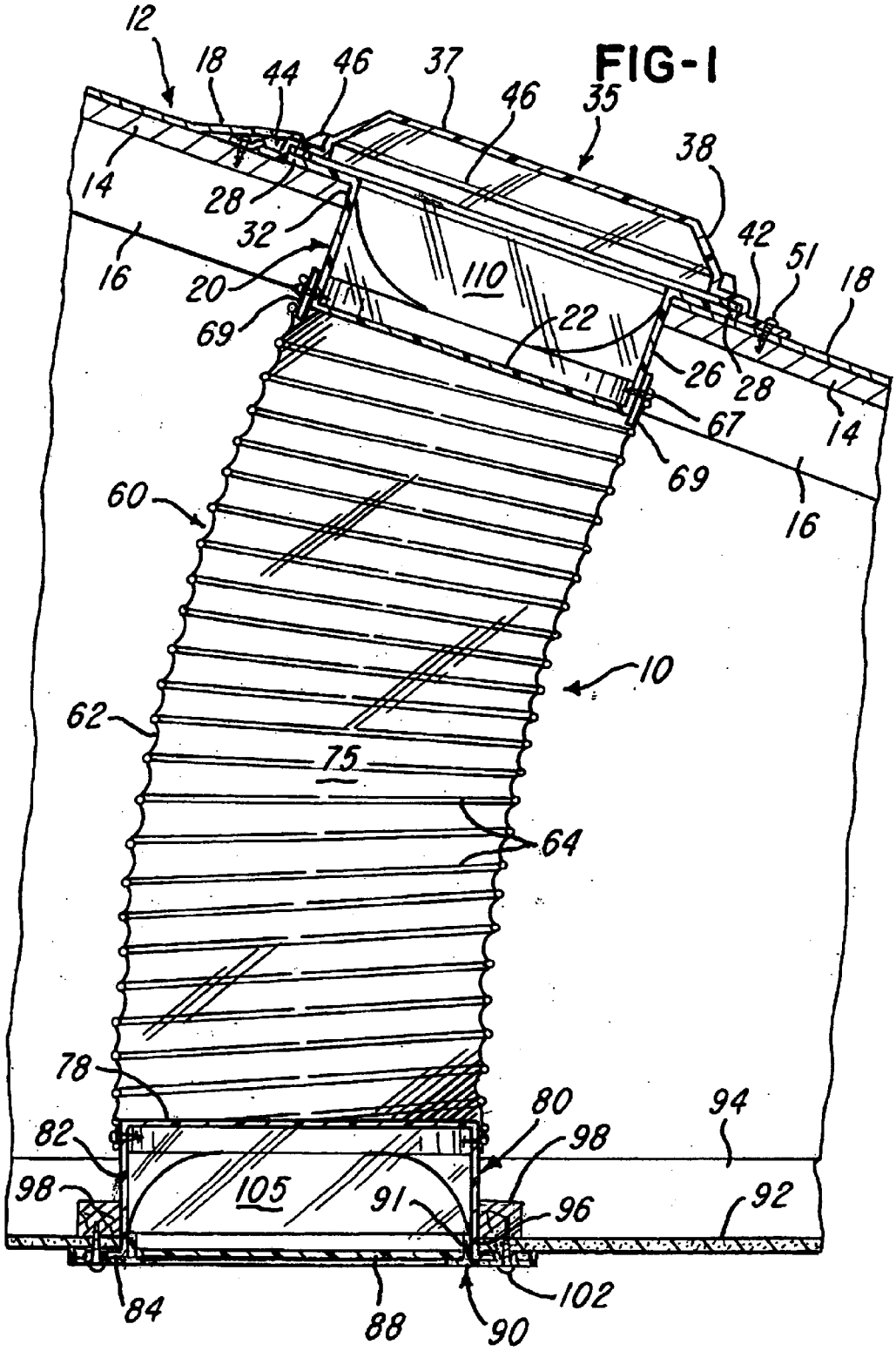
FIG. 1 is a vertical section through a tubular skylight assembly constructed in accordance with the invention and illustrating the assembly installed within the attic of a building or house.

FIG. 1 illustrates a tubular skylight assembly 10 which is installed between an inclined roof 12 having roof sheeting 14 supported by and secured to parallel spaced inclined rafters 16. The sheeting 14 is covered by overlapping shingles 18 or another form of roof covering. The skylight assembly 10 includes an upper coupler member 20 which is vacuum-formed from a light transmitting sheet plastics material such as extruded clear polycarbonate sheet. The coupler member 20 includes a generally round lower wall portion 22 with straight corner portions 23 and rounded corner portions 24. A tapering annular portion 26 integrally connects the lower wall portion 22 to an outwardly projecting upper peripheral flange 28 having a rectangular or square configuration. As used herein, the term rectangular includes square. As shown in FIG. 1, the annular portion 26 projects through a rectangular or square opening 32 within the roof sheeting 14, and the flange 28 projects outwardly over the roof sheeting.

A one-piece skylight panel 35 is vacuum-formed from a light transmitting or clear plastics sheet material such as extruded polycarbonate sheet, for example, as disclosed in U.S. Pat. No. 6,263,624 which issued to the Assignee of the present invention and the disclosure which is herein incorporated by reference. The skylight panel 35 preferably has an emerald-shaped configuration and includes a square flat top wall 37 surrounded by a tapered or beveled wall 38 and an outwardly projecting peripheral flashing portion or stepped flange 42. The flange 42 defines an upwardly facing channel 44 which extends along the top portion and both side portions of the flange, and also includes parallel space and upwardly projecting ribs 46 along opposite sides of the flange.

The flange 42 also has peripherally spaced prepunched holes 48 and projects under the shingles 18 along the top portion and the inclined side portions of the panel, and the flange 42 is secured to the roof sheeting 14 by fasteners in the form of nails or screws 51 extending through the holes 48. As also shown in FIG. 1, the lower portion of the flange 42 overlays the shingles 18 while the shingles along the side portions of the flange cover the channel 44 and butt against the ribs 46. The shingles along the top portion of the flange 42 also cover the channel 44 and extend to the upper ends of the ribs 46. The flange 42 of the skylight panel 35 also receives the upper flange 28 of the upper coupler member 20, and resilient double-sided adhesive sealing strips 54 (FIG. 2) or adhesive strips attach the flange 28 of the coupler member 20 to the flange 42 of the skylight panel 35, as shown in FIG. 1.

The tubular skylight assembly 10 further includes a flexible and axially compressible light reflecting and conducting tube 60 which may be formed in a conventional manner by confining a reinforcing grid between laminated aluminized plastic film tubes 62 and supporting the laminated reinforced tubes with a helically wound spring steel wire 64. The upper end portion of the tube 60 is deformed slightly to fit snugly around the lower wall portion 22 of the upper coupler member 20 and is secured by four peripherally spaced screws 67. Two hollow core plastic breather strips 69 are sandwiched between opposite sides of the lower wall portion 22 and the inner surfaces of the tube 60 to provide air passages to a dead air space or chamber 75 within the tube 60 and to permit quick axial collapsing and extension of the tube 60.

Figure 2:
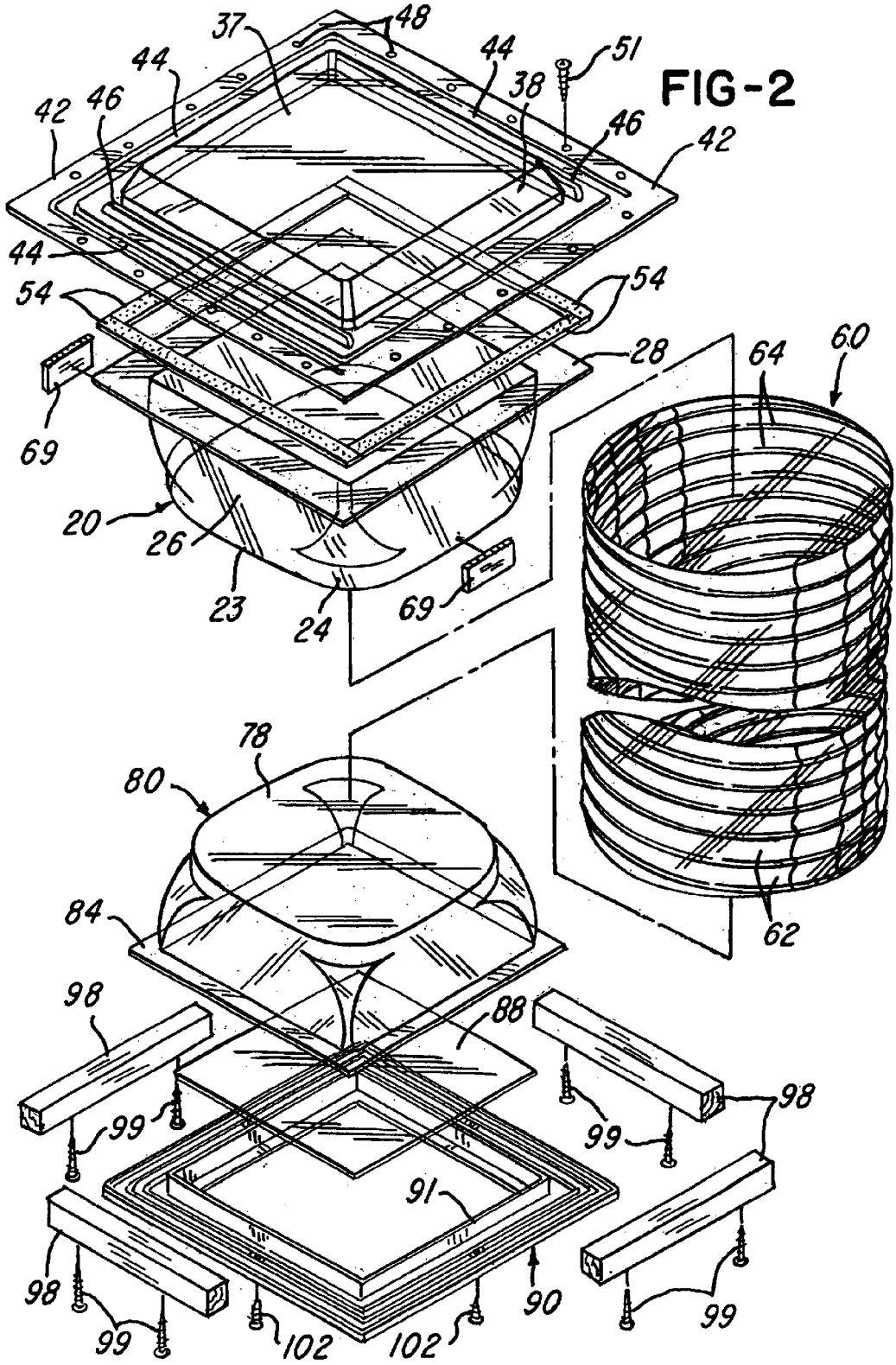
FIG. 2 is an exploded perspective view of the components forming the tubular skylight assembly shown in FIG. 1.

The light conducting tube 60 has a lower end portion which closely surrounds an upper wall portion 78 of a lower coupler member 80 which is constructed substantially the same as the upper coupler member 20. That is, the lower coupler member 80 includes an annular wall portion 82 which tapers from the generally round upper wall portion 78 to a square lower peripheral flange portion 84, as shown in FIG. 2. Another set of four peripherally spaced screws 67 secure the lower end portion of the tube 60 to the upper wall portion 78 of the lower coupler member 80 so that the upper wall portion 78 cooperates with the lower wall portion 22 of the upper coupler member 20 to enclose the tube 60 and form the substantially dead air space or chamber 75.

The lower end portion of the lower coupler member 80 is closed by a generally flat rectangular light transmitting lens or light defusing panel 88 which is received within and supported by a rectangular or square frame 90 preferably molded of a rigid plastics material. The frame 90 has a rib 91 which projects upwardly into the coupler member 80, and the frame is located below ceiling panels or wall 92 which may be formed dry wall panels. The ceiling panels or wall 92 is supported by parallel spaced horizontal joists 94 and has a square opening 96 for receiving the lower coupler member 80. A set of wood backup strips 98 are preattached to the ceiling wall 92 around the opening 96 by a set of screws 99, and the frame 90 is secured to the ceiling wall 92 by a set of screws 102 which extend through premolded holes within the frame and into the wood backup strips 98. As shown in FIG. 1, the lower coupler member 80 cooperates with the light defusing panel 88 to form a dead air chamber 105 below the chamber 75, and the upper coupler member 20 cooperates with the skylight panel 35 to define a third dead air chamber 110 above the chamber 75. Preferably, resilient ceiling strips (not shown) are carried by the outer peripheral portion of the frame 90 to form a generally air-tight seal between the frame 90 and the ceiling wall 92.

The tubular skylight assembly 10 may be partially preassembled by preattaching the upper portion of the light conducting tube 60 to the lower wall portion 22 of the coupler member 20. After the hole 32 is cut within the roof sheeting 14 and in the shingles 18, and the shingles 18 are trimmed back slightly from the hole 32, the tube 60 and coupler member 20 may be lowered into the hole. The lower end portion of the tube 60 is then retrieved through the hole 96 within the ceiling wall 92 and extended below the wall 92 by a few inches where it may then be cut to length. The lower coupler member 80 and preassembled frame 90 are then attached to the lower end portion of the tube 60 within the room below the ceiling wall 92 with the lower flange 84 of the coupler member 80 seated within the frame 90. The lower coupler member 80 and attached frame 96 with the light defusing panel 88 are then elevated until the frame 90 engages the ceiling wall 92 where it is attached by the screws 102. Thus it is possible to install the tubular skylight assembly 10 quickly after cutting the square holes 32 and 96 within the roof sheeting 14 and ceiling wall 92 and without entering the attic space defined between the roof sheeting and ceiling wall. That is, by preassembling the components 20, 35 and 60 and by preassembling the components 80 and 90, only the two preassemblies need to be joined by the installer.

In addition to the above desirable features, the tubular skylight assembly 10 of the invention is ideally suited for use in a modular home section where the roof sheeting 14 and rafters 16 are commonly pivotally connected to the joist 94 adjacent an outer eave of the building. This permits the modular home section to be transported with the roof 12 generally parallel to the joists 94, and the roof 12 is elevated to its inclined position, as shown in FIG. 1, after the modular home section arrives at its destination or construction site with the assembly 10 completely installed. In such a modular home section, the skylight assembly 10 is transported with the light conducting tube 60 in its axially collapsed condition or position and it is moved to its extended position (FIG. 1) at the modular building construction site.

As mentioned above, the dead air spaces 105 and 110 cooperate with the dead air space 75 to provide for highly effective thermal insulation and to prevent condensation from accumulating within the assembly 10. As another feature, since the upper coupler member 20 is vacuum-formed from a light transmitting or clear sheet of plastics material, the upper coupler member 20 provides for adding natural light to the attic space between the roof sheeting 14 and the ceiling wall 92. If desired, the outer surface of the annular portion 82 of the lower coupler member 80 may be painted or coated to avoid viewing the joists 94 through the annular wall 92, especially if the light defusing panel 88 is relatively clear.

While the form of tubular skylight assembly herein described constitutes a preferred embodiment of the invention, it is to be understood that the invention is not limited to this precise form of skylight assembly and that changes may be made therein without departing from the scope and spirit of the invention as defined in the appended claims.

What is claimed is:

1. A tubular skylight assembly adapted for conducting natural light from an incline roof to a horizontal ceiling, said assembly comprising a light conducting tube having an upper end portion and a lower end portion, an upper coupler member of light conducting plastics material and having a lower wall portion closing said upper end portion of said tube and having an upper end portion adapted to be attached to the roof, a light transmitting skylight panel covering said upper coupler member, a lower coupler member of light transmitting plastics material and having an upper wall portion closing said lower end portion of said tube, said lower coupler member having a lower end portion adapted to be connected to the ceiling, and a light transmitting ceiling panel closing said lower end portion of said lower coupler member and adapted to be connected to the ceiling.

2. A skylight assembly as defined in claim 1 wherein said lower wall portion of said upper coupler member is generally round and projects into said upper end portion of said tube, and said upper end portion of said upper coupler member has an outwardly projecting flange for connecting said upper coupler member to the roof and said skylight panel.

3. A skylight assembly as defined in claim 2 wherein said skylight panel comprises a formed sheet of plastics material and having an outwardly projecting integral peripheral flange overlying and adhered to said flange of said upper coupler member.

4. A skylight assembly as defined in claim 1 wherein said upper wall portion of said lower coupler member is generally round and projects into said lower end portion of said tube, said lower end portion of said lower coupler member includes an outwardly projecting flange, and a rectangular frame supporting said light transmitting panel and receiving said flange of said lower coupler member.

5. A skylight assembly as defined in claim 1 wherein said tube is flexible and axially collapsible, and said upper and lower end portions of said tube surround the corresponding said upper and lower wall portions of said upper and lower coupler members.

6. A skylight assembly as defined in claim 5 and including an air inlet and outlet breather passage to permit quick expansion of said flexible collapsible tube.

7. A skylight assembly as defined in claim 1 wherein said upper coupler member includes an annular wall projecting downwardly from an outwardly projecting flange forming said upper end portion, and said annular wall provides for transmitting natural light from said skylight into attic space between the roof and ceiling.

8. A skylight assembly as defined in claim 1 wherein skylight panel, said upper and lower coupler members and said ceiling panel cooperates to define three dead air chambers to provide substantial thermal insulation.

9. A skylight assembly as defined in claim 1 wherein said skylight panel and each of said coupler members comprise vacuum-formed sheets of light transmitting plastics material.

10. A skylight assembly as defined in claim 9 wherein said skylight panel, said upper end portion and said lower end portion of said coupler members and said ceiling panel are substantially square.

11. A skylight assembly as defined in claim 10 wherein said lower wall portion and said upper wall portion of said coupler members are generally round, and said tube has a generally circular cross-sectional configuration.

12. A skylight assembly as defined in claim 1 and including a rectangular ceiling frame supporting said ceiling panel and having an upwardly facing channel receiving said lower end portion of said lower coupler member.

13. A tubular skylight assembly adapted for conducting natural light from an incline roof to a horizontal ceiling, said assembly comprising a light conducting tube having an upper end portion and a lower end portion, an upper coupler member of light conducting plastics material and having a lower wall portion closing said upper end portion of said tube and connected by an annular wall portion to an upper end portion adapted to be attached to the roof, a light transmitting skylight panel covering said upper coupler member, a lower coupler member connected to said lower end portion of said tube and having a lower end portion adapted to be connected to the ceiling, a light transmitting ceiling panel closing said lower end portion of said lower coupler member and adapted to be connected to the ceiling, and said annular wall of said upper coupler member adapted to project below the roof for transmitting natural light from said skylight panel into attic space between the roof and ceiling.

14. A skylight assembly as defined in claim 13 wherein said lower wall portion of said upper coupler member is generally round and projects into said upper end portion of said tube, and said upper end portion of said upper coupler member has an outwardly projecting flange for connecting said upper coupler member to the roof and said skylight panel.

15. A skylight assembly as defined in claim 14 wherein said skylight panel comprises a formed sheet of plastics material and having an outwardly projecting integral peripheral flange overlying and adhered to said flange of said upper coupler member.

16. A skylight assembly as defined in claim 13 wherein said lower coupler member includes a generally round upper wall portion projecting into and closing said lower end portion of said tube, said lower end portion of said lower coupler member includes an outwardly projecting flange, and a rectangular frame supporting said light transmitting panel and receiving said flange of said lower coupler member.

17. A skylight assembly as defined in claim 13 wherein said tube is flexible and axially collapsible, and said upper end portion of said tube surrounds said lower wall portion of said upper coupler member.

18. A skylight assembly as defined in claim 13 wherein said skylight panel and each of said coupler members comprise vacuum-formed sheets of light transmitting plastics material.

19. A skylight assembly as defined in claim 18 wherein said skylight panel, said upper end portion and said lower end portion of said coupler members and said ceiling panel are substantially square.

20. A skylight assembly as defined in claim 19 wherein said lower wall portion of said upper coupler member is generally round, and said tube has a generally circular cross-sectional configuration and surrounds said lower wall portion of said upper coupler member.

21. A tubular skylight assembly adapted for conducting natural light from an incline roof to a horizontal ceiling, said assembly comprising a flexible and axially expandable light conducting tube having an upper end portion and a lower end portion, an upper coupler member of light conducting plastics material and having a generally round lower wall portion closing said upper end portion of said tube and having a generally square upper flange portion adapted to be attached to the roof, a light transmitting skylight panel covering said upper coupler member, a lower coupler member of light transmitting plastics material and having a generally round upper wall portion closing said lower end portion of said tube, said lower coupler member having a generally square lower flange portion adapted to be connected to the ceiling, and a generally square light transmitting ceiling panel and frame closing said lower flange portion of said lower coupler member and adapted to be connected to the ceiling.

22. A skylight assembly as defined in claim 21 wherein said skylight panel comprises a formed sheet of plastics material and having an outwardly projecting integral peripheral flange overlying and attached to said flange of said upper coupler member.

23. A skylight assembly as defined in claim 21 wherein skylight panel, said upper and lower coupler members and said ceiling panel cooperates to define three dead air chambers to provide substantial thermal insulation.

24. A skylight assembly as defined in claim 21 wherein said skylight panel and each of said coupler members comprise vacuum-formed sheets of light transmitting plastics material.

* * * * *